United States Patent [19]

Brumlik

[11] 3,981,051

[45] Sept. 21, 1976

[54] BRISTLE-LIKE GRIPPING DEVICE

[76] Inventor: George C. Brumlik, 154 Upper Mountain Ave., Montclair, N.J. 07042

[22] Filed: Apr. 26, 1973

[21] Appl. No.: 354,814

Related U.S. Application Data

[63] Continuation of Ser. No. 184,172, Sept. 27, 1971, abandoned, which is a continuation of Ser. No. 19,800, Mar. 16, 1970, now abandoned.

[52] U.S. Cl. ..... 24/204; 85/13; 85/21

[51] Int. Cl. ..... A44b 17/00

[58] Field of Search ..... 24/204; 85/13, 21, 5 R

[56] References Cited

UNITED STATES PATENTS

| | | | |
|---|---|---|---|
| 920,808 | 5/1909 | Alcott | 24/204 |
| 1,768,624 | 7/1930 | McGuire | 24/204 |
| 2,058,020 | 10/1936 | Jaffe | 85/13 |
| 2,190,883 | 2/1940 | Pauze | 85/21 |
| 2,974,378 | 3/1961 | Lidsky | 85/13 |
| 3,121,366 | 2/1964 | Panzer | 85/21 |
| 3,123,077 | 3/1964 | Alcamo | 24/204 |
| 3,166,072 | 1/1965 | Sullivan | 24/204 |
| 3,477,334 | 11/1969 | Stone | 85/21 |
| 3,494,006 | 2/1970 | Brumlik | 24/204 |
| 3,522,637 | 8/1970 | Brumlik | 24/204 |
| 3,748,701 | 7/1973 | DeMestral | 24/204 |

FOREIGN PATENTS OR APPLICATIONS

| | | | |
|---|---|---|---|
| 1,228,280 | 8/1960 | France | 85/13 |
| 1,551,245 | 11/1968 | France | 24/204 |
| 295,638 | 3/1954 | Switzerland | 24/204 |

*Primary Examiner*—Bernard A. Gelak
*Attorney, Agent, or Firm*—Burgess, Dinklage & Sprung

[57] ABSTRACT

A self-gripping device is disclosed and includes a plurality of thin bristle-like gripping elements attached in close proximity to each other to a base. Each of the gripping elements have self gripping means spaced along the length thereof and they extend substantially perpendicularly from the base with some of the self gripping means biased towards the base. The gripping elements are adapted to penetrate and become lodged in a receiving layer for self gripping engagement therewith.

18 Claims, 24 Drawing Figures

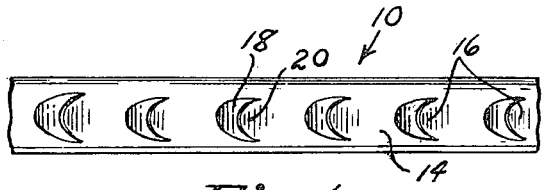
Fig.1
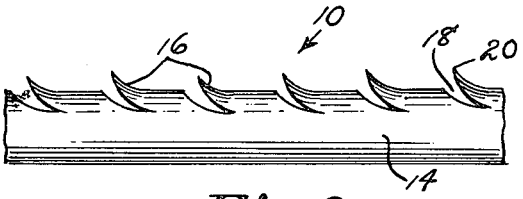
Fig.2
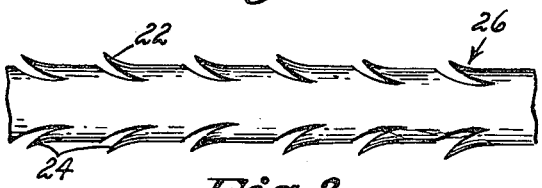
Fig.3
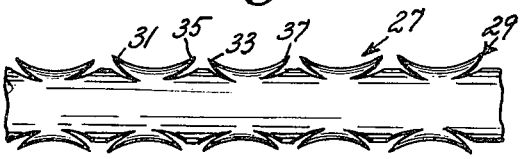
Fig.4
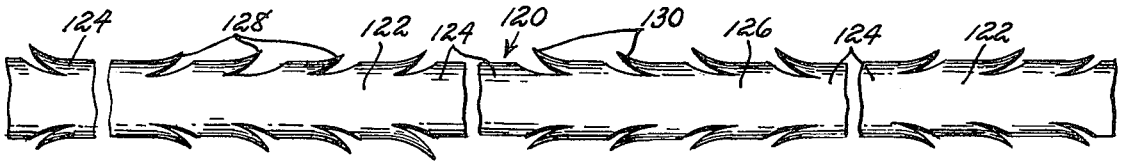
Fig.5
Fig.6
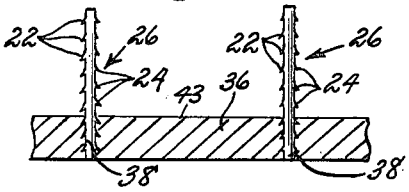
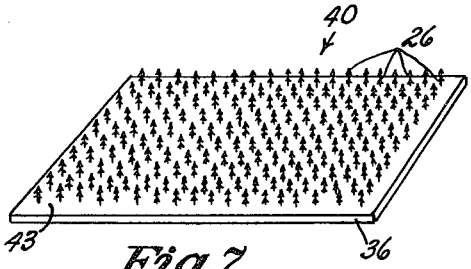
Fig.7
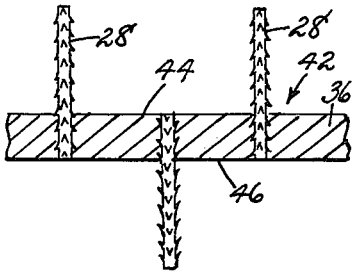
Fig.8
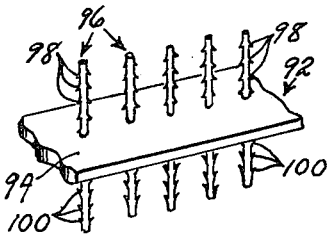
Fig.9
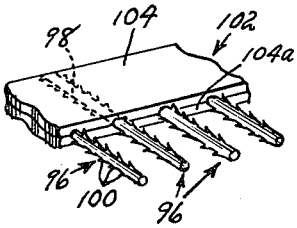
Fig.10
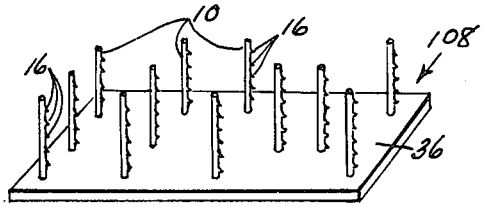
Fig.11

Fig.12
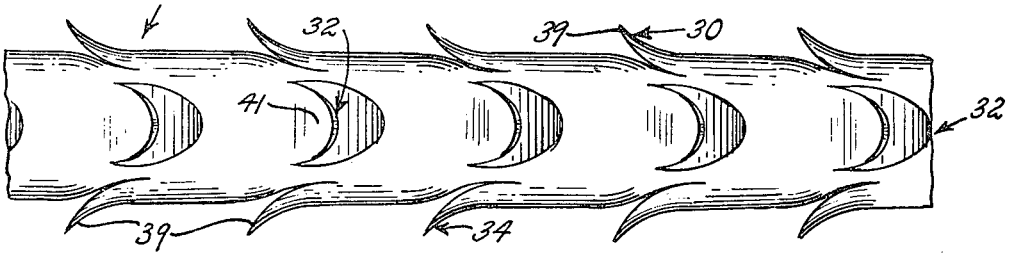
Fig.13
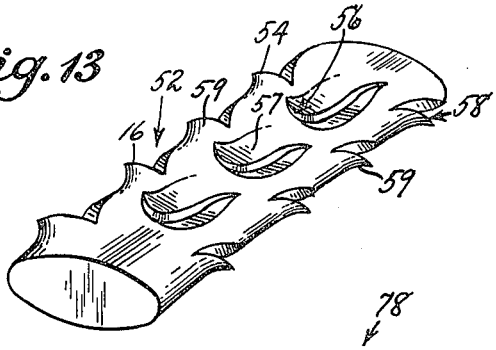
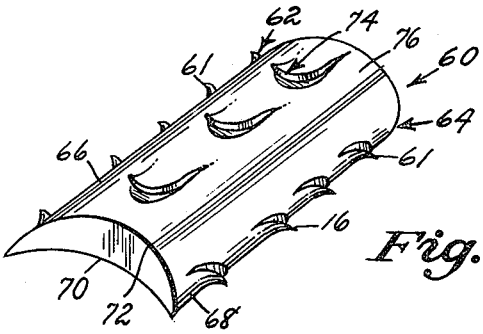
Fig.14
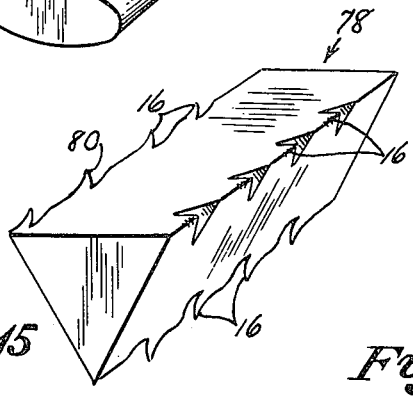
Fig.15
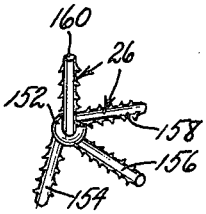
Fig.21
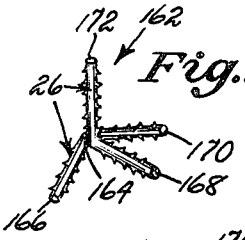
Fig.22
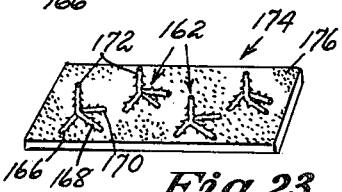
Fig.23
Fig.17
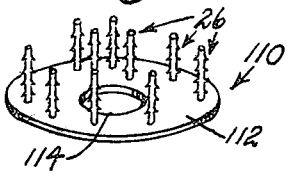
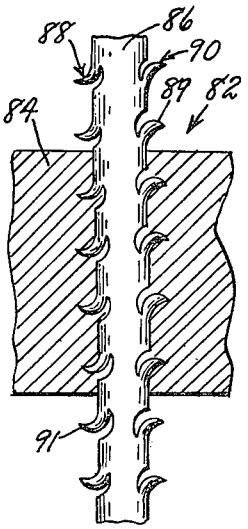
Fig.16
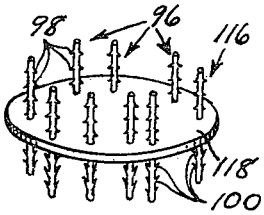
Fig.18
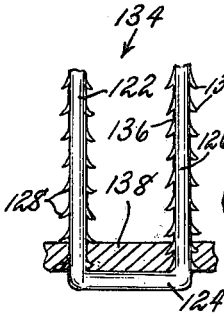
Fig.19
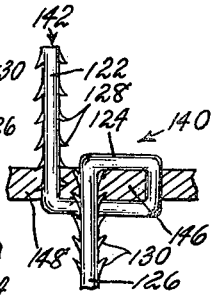
Fig.20
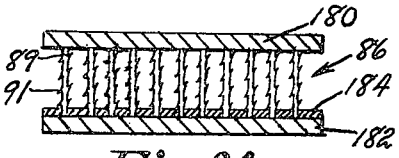
Fig.24

BRISTLE-LIKE GRIPPING DEVICE

RELATED APPLICATION

This is a continuation of application Ser. No. 184,172, filed Sept. 27, 1971, now abandoned, which is in turn a continuation of application Ser. No. 19,800, filed Mar. 16, 1970 and now abandoned.

BACKGROUND

The present invention relates to self-gripping devices and in particular to a novel and improved self-gripping device which is operative to grip a receiving layer upon contact therewith in a self-gripping action.

Various self-gripping fasteners, particularly suitable for releasably fastening fabrics and the like are presently available. Typical of such fasteners is a self-gripping fastener assembly presently marketed under the trademark "Velcro" and which is in the form of pairs of fabric strips which are respectively sewn or otherwise secured to the opposing fabrics to be fastened together. In the Velcro fastener, multiple rows of small vertically extending open plastic loops are secured to the outer surface of one of the matching strips, while matching small plastic hooks are secured to the outer surface of the opposite strips. Thus, when the two opposing strips are press-contacted, the hooks on one strip link with the opposing loops so that the opposing strips are interlocked in a gripping action. The opposing strips may be released by pulling them apart with sufficient force to cause the above mentioned hooks to disengage from their corresponding loops.

While the above described Velcro fastener provides an effective gripping action, the cost of manufacture thereof is relatively expensive. Furthermore, it is apparent that a Velcro type grip requires that both of the opposing surfaces have matching Velcro type strips in order to effect an interlocking grip.

The present invention is directed to a fastener device which is relatively inexpensive and simple to manufacture and is advantageous over the Velcro type fastener in that only one surface is provided with fastener means.

It is therefore an object of the present invention to provide an economical and simple fastening device operative to grip an opposing penetrable article. It is a further object of the present invention to provide a fastening device which is made of notched metal wire and which is economical in manufacture, possesses superior strength properties, electrical conductivity, and is highly versatile in use.

SUMMARY

The self-gripping device of the present invention includes a plurality of thin bristle-like elements attached in close proximity to each other to a base. Each of the gripping elements have self-gripping means such as notched barbs, spaced along the length thereof. The gripping elements extend substantially perpendicularly from the base with at least some of the self-gripping means biased towards the base. The gripping elements are adapted to penetrate and become lodged in a receiving layer for self-gripping engagement therewith.

DESCRIPTION OF THE DRAWINGS

FIG. 1 is a top plan view on an enlarged scale of a portion of a gripping element suitable for use in the self-gripping device of the invention;

FIG. 2 is a side elevational view of the gripping element shown in FIG. 1;

FIGS. 3 and 4 are elevational views on an enlarged scale of portions of two gripping elements suitable for use in the self-gripping device of the invention;

FIG. 5 is an elevational view on an enlarged scale of a length of wire formed for cutting into gripping elements with intermediate portions of the wire being broken away;

FIG. 6 is an elevational view on an enlarged scale of a plurality of gripping elements shown attached to a portion of a base shown in cross-section;

FIG. 7 is a perspective view of a self-gripping device of the present invention, in which a plurality of gripping elements are secured to a sheet;

FIG. 8 is an elevational and partial sectional view of an alternate embodiment showing a plurality of gripping elements secured to and extending from both side of a base;

FIG. 9 is a perspective view on an enlarged scale of another embodiment of a self-gripping device in which a plurality of gripping elements are attached in a row to a strip, and project from both sides thereof;

FIG. 10 is a perspective view of another embodiment in which a row of gripping elements extend from the edge of a composite strip.

FIG. 11 is a perspective view of a self-gripping device in which a plurality of gripping elements are attached to a base with the barbs of the gripping elements oriented in the same direction;

FIG. 12 is an elevational view on an enlarged scale of a portion of a gripping element in accordance with another embodiment of the invention;

FIGS. 13 to 15 are perspective views on an enlarged scale of portions of further alternate embodiments of gripping elements;

FIG. 16 is an elevational view of a portion of another alternate embodiment wherein a gripping element is shown mounted in a base shown in section;

FIG. 17 is a perspective view of a disc-shaped self-gripping device of the invention;

FIG. 18 is a perspective view of a disc-shaped device similar to FIG. 17, but having gripping elements projecting from both sides thereof;

FIG. 19 is an elevational and partial sectional view, on an enlarged scale, showing the type of gripping element of FIG. 5, formed as a U and secured to a base;

FIG. 20 is an elevational and partial sectional view similar to FIG. 19 but showing a gripping element formed as a closed loop and secured to a base to extend from both sides thereof;

FIGS. 21 and 22 are perspective view showing alternate types of gripping elements formed of two members joined together in the shape of a tetrahedron;

FIG. 23 is a perspective view showing a plurality of tetrahedron-shaped gripping elements attached to a base;

FIG. 24 is a sectional view showing one manner in which gripping elements may be mounted on a base.

DESCRIPTION

Referring in detail to the drawings, there is shown in FIGS. 1 and 2, on an enlarged scale, a portion of a gripping element 10 which is adapted to be secured, along with a plurality of like fastening elements, in an upstanding position to a base. The gripping element 10 comprises a thin bristle-like member 14 having a plurality of self-gripping means along the longitudinal extent thereof, such means, in FIG. 1 embodiment, being in the form of a plurality of barbs 16.

The barbs 16 may be formed by passing a length of wire of circular cross-section through a machine which is operable to nick or otherwise cut or upset the wire at longitudinally spaced locations to provide adjoining indentations 18 and protrusions 20 which define the aforesaid barbs 16. For example, such machine may have one or more rotatable screws with knife edges arranged with their longitudinal axes parallel to the wire, whereby the rotating knife edges partially cut the sides of the wire as the latter is fed longitudinally in the path of rotation of the knife edges. The self-gripping means may also be formed by pressing a non-rotating die having spaced protrusions, in the form of knife edges or the like, into the sides of the wire.

In FIG. 2, the barbs 16 are shown generally disposed at an acute angle relative to the longitudinal axis. However, this angle may vary up to and including 90°.

Although in FIGS. 1 and 2 only a single longitudinally aligned row of barbs 16 all facing the same direction are shown, it will be understood that various other arrangements may be used. For example, a plurality of longitudinal rows of barbs may be employed as indicated, for example, by the two rows of barbs 22 and 24 shown in the alternate gripping element 26 in FIG. 3. Further, the barbs 16 need not be arranged in longitudinal rows but may be randomly and uniformly disposed or in some other pattern such as a spiral. In addition, some of the barbs may be made to face towards one longitudinal end of the wire and other barbs towards the opposite end.

For example, FIG. 4 shows a portion of an alternate gripping element 27 having a generally circular cross-section in which a plurality of rows of barbs, similar to the barbs 16, are formed. It will be readily apparent in the drawing that alternate barbs in each longitudinal row face in opposite directions. In row 29, for example, alternate barbs 31, 33 face in one direction and alternate barbs 35, 37 face in the opposite direction. The gripping element 27 in FIG. 4 may be attached embedded or anchored to a base to form a self-gripping device in a manner described below.

As another example, FIG. 12 shows a portion of a further alternate gripping element 28 having four longitudinal rows 30, 32, 34 (only three visible) of the barbs in which the barbs 39 of two rows 30 and 34 face towards the left and the barbs 41 of the other two rows 32 (only one visible) face towards the right. The individual barbs 39, 41 in adjacent rows may also be longitudinally staggered as shown in FIG. 12.

Turning now to the self gripping device, FIG. 6 shows a plurality of gripping elements, for example gripping elements 26 of the type shown in FIG. 3, attached to a base 36. Each gripping element 26 projects generally upright from one side of the base 36 and is attached to the latter as by embedding the base portion 38 of the gripping element 26 within the base 36, with the barbs 22, 24 serving to anchor the gripping element within the base.

FIG. 6 shows, for clarity of illustration, only a pair of gripping elements 26 on a portion of a base 36. However, in order to form a complete device, a larger number of such gripping elements 26 are utilized. Thus, FIG. 7 shows a device 40 comprising a sheet-like base 36 to which has been attached a plurality of upright gripping elements 26. The device 40 is intended to be secured to an opposing receiving layer. To fasten device 40 to an opposing layer, it is pressed against a surface of the opposing layer with sufficient force to cause the gripping elements 26 to penetrate the opposing material and lodge therein. Device 40 will thus be firmly interlocked with the opposing material by the combined self-gripping action of the large number of gripping elements 26 embedded and locked in the opposing material. The size, number and distribution density of gripping elements 26 on base 36 will be determined by the size and nature of the opposing material to be gripped, as described hereinafter in greater detail.

In the preferred form of the device 40, the gripping elements 26 are of uniform size and are made small for mounting closely to one another in a uniform arrangement on the base 36 in the manner shown in FIG. 7. Typically, the gripping elements 26, as well as the alternate embodiments illustrated in FIGS. 1, 2, 4 and 12 have an overall length ranging approximately from one-sixty-fourth to one-half inch, and a diameter ranging approximately from five-ten-thousandths to five-hundredth of an inch.

Typically, the base 36 may be made of plastic, wood, leather, rubber, fabric, mesh, metal or the like.

The self-gripping device of the invention is also preferred to as a fastening device for connecting pairs of articles wherein only one article is required to be provided with the device. The bristle-like gripping elements are also referred to as fastening elements and the self-gripping means as hook means. The gripping elements are secured or attached to a body or base.

In order to render a device capable of self-gripping and opposing material, a large number of gripping elements are required to be secured to the base 36. This may be accomplished by machine, for example by inserting the gripping elements in a direction perpendicular to the surface 43 of base 36 to embed the base portions 38 in base 36. The gripping elements may also be inserted by projecting them into the base 36 by means of a jet of air.

The gripping elements are inserted or projected in this manner with sufficient force to cause the lower base portion 38 to penetrate the base 36 to a sufficient depth so that there will be provided sufficient lateral support to maintain the gripping element substantially perpendicular to the surface 43 of the base 36. It will be appreciated that a large number of gripping elements may be applied rapidly by machine as aforesaid and further, that such elements may be applied in a uniform or other predetermined pattern in which the elements are selectively spaced throughout the device 40.

Instead of being embedded in base, as previously described, the gripping elements may be secured to a metal base by welding or brazing them in upstanding position on the surface thereof, or the elements may be secured to a non-metal base or article by applying them to a layer of adhesive or molten glass on the surface of the base. When the gripping elements are made from a metal wire such as steel, they may be readily assembled for such mounting by applying a magnetic field which causes the gripping elements to rise in upstanding position. The base is then brought against the ends of the upstanding elements and are attached to the surface of the base by brazing or by adhesive in the manner previously indicated. This method of mounting is shown in FIG. 24, and is described in detail below.

It will be recalled that in gripping element 28 (FIG. 12), the barbs 39, 41 in alternate longitudinal rows 30,

32, 34 face in opposite directions. Accordingly, when the elements 28 are mounted in a base such as base 36, the barbs 41 which are biased toward surface 43 will grip the base 36 to anchor the element and prevent its extraction.

When employing gripping elements in which the barbs all face in the same direction, for example the elements 10 and 26 shown in FIGS. 1, 2 and 3, such elements are inserted in the base 36 so that the exposed barbs face toward the surface 43 and are thus in a position for self-gripping engagement. In FIG. 6, for example, the barbs 22, 24 are shown facing the surface 43 of base 36.

In the latter described embodiment, since the barbs 22, 24 embedded in the base 36, face away from the surface 43, when a force tends to pull the exposed portion of the gripping elements out of the base 36, such barbs will not grip the material of the base 36 as securely as if the barbs were facing the opposite direction. However, the barbs 22, 24 may be made with larger lateral projecting portions and their angle to the axis of the elements 26 made larger in order to enhance the anchorage of the elements in the base 36. The strength of the anchorage, depends, among other things, on the properties of the material of the base 36. Accordingly, when the latter is made of less resilient materials, for example wood or other construction materials, secure anchorage may be obtained with the barbs arranged as aforesaid. Alternatively, gripping elements of the type shown in FIGS. 1–3, wherein the barbs all face in the same direction, may be applied by forming them into the U-shaped staple-like elements, as will be further described in connection with the embodiment in FIG. 19, so that the bottom of the U engages the underside of the base to prevent the elements from being pulled out.

With a large number of upright gripping elements 26 secured in relatively thick profusion to the base 36 as shown in FIG. 7, the device is capable of self-gripping a receiving layer which is sufficiently soft or porous to be penetrated by the individual gripping elements.

For example the receiving layer, material or object (also termed an opposed object or material and an opposed penetrable body or object) may be made of plastic, leather, rubber, fabric, wire, mesh or the like.

The device 40 may be secured to the receiving layer by pressing it thereagainst with sufficient pressure to cause the gripping elements 26 to penetrate the layer to a depth dependent upon the particular material involved or the spacing desired. When such pressure is exerted on the device 40, the barbs 22, 24 of each element 26 will enter the opposed object, and because the fastening elements are generally made of a hard material and the receiving layer made of a softer material, the barbs will penetrate the layer to the desired depth. When the device 40 is applied to a layer, as above described, the inserted barbs provide a considerable resistance to disengagement. Thus, when force is applied in the opposite direction, the free ends of all barbs 22, 24 act as hooks to restrain movement of the barbs out of the receiving layer. For a given receiving material, the resistance to disengagement therefrom will be determined by the inclination, shape and rigidity of the barbs which are engaged by the penetrable receiving material and by the number of barbs so engaged. With the barbs formed in the wedge shapes illustrated, the adhesion provided thereby is relatively permanent, that is to say, the barbs will resist withdrawal of the gripping elements from the receiving material unless sufficient force is applied thereto to cause some yielding of the receiving material. However, repeated attachment and detachment is still possible.

FIG. 8 is an alternate embodiment wherein there is shown a portion of a device 42 having gripping elements extending from both sides 44, 46 of the base 36. With this arrangement, receiving objects may be fastened to both sides of the device 42, thereby dispensing with having to first secure (e.g. by adhesive of the like) the base 36 to an object which is to be attached to another object by a self-gripping connection. Thus, when it is desired to fasten two receiving objects, the device 42 is disposed between the two objects and the latter are pressed towards one another thereby causing the gripping elements 28 on each side of base 36 to penetrate both objects to fasten them to one another.

FIGS. 13 to 15 show further alternate gripping elements which have different cross-sectional configurations. The gripping element 52 in FIG. 13 has an eliptical cross-sectional configuration and includes a plurality of longitudinal rows of barbs 54, 56, 58. The barbs 57 and 59 of alternate rows face in opposite directions, and the barbs in adjacent rows are longitudinally staggered. In FIG. 14, gripping element 60 has a cross-sectional configuration representing a portion of a circle similar to the configuration of a quarter moon. Barbs 61, facing in the same direction, are disposed in two rows 62, 64 along two longitudinal lines 66, 68 at the juncture of the two partial circles 70 and 72 and barbs 63, facing in the opposite direction are disposed in a row 74 along the outer cylindrical, convex surface 76. It will be appreciated that because the two rows 62, 64 of barbs 61 are formed where two relatively sharply converging surfaces 70, 72 meet, the barbs 61 will tend to be more pointed and sharper, thereby enhancing their self-gripping action. Any number of rows or barbs may be disposed on the outer cylindrical surface 76 and different rows of barbs may face in opposite directions.

In FIG. 15, a gripping element 78 has a triangular cross-sectional configuration with the barbs 16 being formed at the three corners of the triangle. Here again the barbs are formed at two converging surfaces tending to make them more pointed and sharper.

The gripping elements in FIGS. 1 to 4 and 12 to 15 are representative of the many forms and variations of gripping elements which can form the self-gripping device of the invention; many other configurations and arrangements of the same or other forms can be employed.

FIG. 16 shows a portion of an alternate device 82 having a base 84 in which a plurality of gripping elements 86 pass completely through the base 84 to extend from both sides thereof. The gripping element 86 has a pair of rows 88, 90 of barbs 89, 91 with the barbs 91 in row 88 facing downwardly and the barbs 89 in row 90 facing upwardly. Of course, any number of rows of barbs may be employed. The device 82 in FIG. 16 is adapted to function similarly to the device 42 in FIG. 8, previously described, in that the gripping elements extend from both sides of the base and receiving objects may be fastened to both sides of the device. The row of upwardly facing barbs 89 and the row of downwardly facing barbs 91 provide the gripping action for self-gripping receiving objects on the top and on the bottom respectively, of the device 82.

FIG. 9 illustrates device 92 in accordance with the invention having on opposite side single rows of gripping elements of the type heretofore described. The device 92 comprises an elongated base 94 in the form of a strip or ribbon upon which are mounted a plurality of gripping elements 96 in a row extending centrally and longitudinally along the base. Each element 96 is formed with a plurality of barbs 98 extending in selected rows over one-half of the length of the element with the barbs 98 facing the center of the element. On the other half of the element 96, there is formed a plurality of barbs 100 arranged in selected rows, with the barbs 100 also facing the center of the element 96, that is to say, the barbs 98 and the barbs 100 face in opposite directions.

The gripping elements 96 are mounted upon the base 94 of device 92 in the manner shown in FIG. 9 with the center of each element 96 embedded within base 94 and the end portions of each element 96 projecting perpendicularly from the top and bottom surfaces of base 94. Thus, the barbs 98 of the elements are located at one side of the body 94 and the barbs 100 are located at the other side of said body. In this instance, device 92 is intended to be mounted flush upon a receiving material such as a layer of fabric, by embedding one row of projecting ends of the elements 96, for example the ends containing the barbs 100, within the receiving material. This leaves an exposed row of the opposite ends of the elements 96, containing the barbs 98, projecting perpendicularly from the receiving material. Another receiving material, such as another layer of fabric may then be pressed against the first receiving material and secured thereto by penetration of the gripping elements 96 and gripping of the barbs 98. The device 92 is thus suitable for use in joining two or more layers of fabric or the like, as a substitute for the usual lines of stitching employed for this purpose.

FIG. 10 shows a device 102 in which the same elements 96 of FIG. 9 are employed, but in a different manner. In this embodiment, a relatively flat elongated base 104 in strip form is provided, the base having a side edge 104*a*. The elements 96 are inserted laterally through the side edge 104*a* so that their half-sections containing barbs 98 are embedded in the base 104. The other half sections project in a linear row from the side edge 104*a* with the barbs 100 exposed. ; The device 102 is intended for use in the edgewise fastening of two members, in the manner of a slide fastener. That is to say, one elongated device 102 may be secured along the edge of a fabric garment, for example, and a second elongated device 102 secured along a matching edge of the garment, so that when the edges are brought together in close, parallel relationship, the exposed barbs 100 of both devices 102 will interengage to releasably fasten the garment edges together. The device 102 may also be used in a different manner by inserting the exposed elements 96 into the surface of receiving article and thereby attaching the device 102 perpendicularly to said article surface.

FIG. 11 illustrates a device 108 similar to the device 40 of FIG. 7, and comprising a sheet-like base 36 upon which has been mounted a plurality of gripping elements. In this instance, the elements of FIGS. 1 and 2 are used with each element 10 having a single row of barbs 16. The elements 10 are mounted in oriented positions with the respective rows of barbs 16 all facing in the same direction. This orientation of the barbs 16 permits the device 92 to be removably attached to a receiving article by pressing the base 36 thereagainst with sufficient force to cause the barbs 16 to penetrate the receiving article. The base 36 is then moved laterally in the direction of the oriented rows of barbs 16, causing the barbs to lodge within the receiving material. To remove the device 92, the base 36 is moved laterally in the opposite direction, causing the barbs 16 to disengage, and the device 92 is lifted off.

FIGS. 17 and 18 illustrate the use of the gripping elements in small self-gripping devices which may be used in the manner of conventional snap fasteners and can effectively replace the latter. In FIG. 17 the device 110 comprises a small flat circular base 112 of fabric or other suitable material having a central aperture 114. On one surface thereof, a plurality of the elements 26 of FIG. 3, are mounted in thick profusion around the central aperture 114. The device 110 is mounted on an object, for example a garment, by any suitable means, such as by insertion of a rivet or eyelet through the central aperture 114, so that the barbed gripping elements 26 project perpendicularly from the surface of the object. When receiving material, such as another portion of the garment, or a garment accessory, is brought into surface contact with the device 110 and pressed thereagainst, the barbed elements 26 penetrate and grip same.

FIG. 18 illustrates a modified form of snap fastener type device 116, in which the elements are also used for mounting the device on an object, and no rivet or other separate mounting means is required. The base 118 of device 116 is again circular, but has no central opening. In this embodiment, elements 96 of FIG. 9 are employed projecting half-way through base 118 with the half-sections thereof respectively bearing the barbs 98 and 100, projecting perpendicularly from the opposed surfaces of base 118. The barbs 100, for example, can then be employed to mount the device 116 on an object, and the exposed barbs 98 employed to fasten the object to a receiving material or article.

As previously indicated, the gripping elements may be made in U-shaped, staple-like form for secure attachment to a base. FIG. 5 illustrates an elongated member in the form of a metal wire 120, from which gripping elements may be cut for this purpose. The wire 120 is formed in alternating, successive sections 122, 124 and 126. The section 122 is formed, in the manner previously described, with two or more rows of barbs 128, all facing in one direction, that is to the right as viewed in FIG. 4. The section 126 is similarly formed with rows of barbs 130 all facing in the opposite direction, i.e. toward the left as viewed in FIG. 4. The sections 122 and 126 are separated by the section 124 which has a smooth cylindrical surface with no barbs formed thereon. The wire 120 is cut up into short lengths to provide a plurality of gripping elements, each having a barbed section 122 at one end, a barbed section 126 at the other end, and a smooth section 124 therebetween. The lengths of the various sections 122, 124 and 126 will be varied selectively, depending upon the manner in which the gripping elements are to be used.

FIG. 19 shows a device 134 including gripping elements 136 made from a cut section of the member 120 of FIG. 5. The element 136 is bent in U-shaped form having parallel legs formed of sections 122 and 126, and a cross leg or bottom formed of section 124. The legs formed of sections 122 and 126 present respective barbs 128 and 130 as previously described. The elements 136 may be readily applied to a base 138 by causing the upright, barbed legs of the U-shaped member to penetrate the base 138 in the manner of a staple, the aforesaid being effected by a suitable machine. Alternatively, the element 136 may be applied by machine wherein a straight length of wire, having the three sections previously described, is forced longitudinally downward through the base 138 until two of the sections have penetrated the base. Upon emerging from the lower surface of the base 138, the end portion of the wire will encounter an abutment or die disposed beneath the base 138, which will turn the wire upwardly to again penetrate the base 108 and thereby form the U.

In either event, it will be seen in FIG. 19 that both parallel legs 122 and 126 of the element 136 project perpendicularly through the base 138, with their respective barbs 128 and 130 embedded within the base 138 to prevent the element 136 from being moved downwardly in base 138. The cross-leg or bottom 124 underlies the base 138 and prevents upward movement of the element 136, so that the latter is securely mounted on the base 138. It will be appreciated that a large number of elements 136 may be applied rapidly by machine as aforesaid, and that such elements may be applied in predetermined, uniform or irregular patterns. After application, the barbs 128 and 130 on both legs are biased towards base 138 and are thus oriented to penetrate and grip a receiving layer.

FIG. 20 shows another manner in which a length of the sectioned metal wire 120 of FIG. 5 may be employed. In this embodiment, the device 140 includes an element 142 formed into a closed loop 146, wherein a portion of the this embodiment, the device 140 includes an element 142 formed into a closed loop 146, wherein a portion of the base 148 is enclosed within the loop 146. The element 142 may be applied to the base 148 by starting with a straight length of wire and forcing the sections 124 and 126 longitudinally through the base until only the barbed section 122 projects from the upper surface thereof. As the wire penetrates, it engages suitable dies (not shown) located above and below the base 148 to cause the wire to form the closed loop 146 within which a portion of the base is enclosed. Thus, the wire may initially be forced longitudinally downwardly by a machine to penetrate the base 148. Upon emerging from the base, the end of the wire will encounter a first abutment on a lower die to turn the wire upwardly to again penetrate the base 148. Upon emergence from the top of the base, the end of the wire will encounter an abutment on an upper die to turn the wire downwardly to again penetrate the base, thereby forming the loop 146. Thus, element 142, in having a section looped about a portion of the base 148, will be firmly anchored to base 148. In FIG. 20 with the element 140 in position, the leg 122 projects from one surface of the base 148 and the leg 126 projects from the opposite surface of said base, with the respective barbs 128 and 130 both biased towards the base 148.

FIGS. 21 and 22 illustrate further embodiments of gripping elements made in the form of tetrahedrons. In FIG. 21, the element 150 is formed of two barbed members 26 of the type shown in FIG. 3, for example; one of said members 26 being wrapped around the center of the other to form a loop 152. The ends of the members 26 are then bent to form the shape of a tetrahedron, with three base legs 154, 156, 158, and one upstanding leg 160.

FIG. 22 shows a similar gripping element 162 in which two barbed members 26 are joined together by cementing or welding at 164. Again, the members 26 are bent to form the shape of a tetrahedron, presenting three base legs 166, 168 and 170, and one upstanding leg 172.

FIG. 23 shows the manner in which the tetrahedron elements of FIGS. 21 and 22 may be attached to a base to form a self-gripping device 174. By way of illustration, the device 174 of FIG. 23 is shown as including a plurality of the elements of FIG. 22 mounted on a sheet-like base 176. The base 176 may, however, be of any other form, provided that it has a surface capable of being penetrated by the barbs of the gripping elements, for example a soft metal, 1 plastic, fabric, felt, hair or similar surface. The elements, 162 can be dropped upon the surface of base 176, with the three base legs 166, 168 and 170 resting upon the surface and the barbs thereof grasping the material of the surface to retain the elements. The upstanding legs 172 project perpendicularly from the surface of base 176, and are thus capable of penetrating and gripping a receiving layer.

As was previously indicated, the gripping elements made of short straight lengths of magnetically-attractable wire may be readily mounted by the employment of a magnetic field. FIG. 24 illustrates an arrangement for this purpose. A large supply of elements 86 are deposited upon the surface of a plate 180, which may also be made in the form of a cylindrical drum, and a magnetic field is applied to plate 180 in such a manner as to cause the elements to arrange themselves perpendicularly to the surface of said plate. The plate 180 is now inverted over a base 182 which may also serve as the opposing pole of the magnetic field, and the free ends of the fastening elements 86 are secured to the base 182 by a layer 184 of adhesive, brazing alloy, or the like. In this instance, the elements employed are the elements 86 shown in FIG. 16 having barbs 89 and 91 facing in opposite directions. This type of element is used because the elements are not self-orienting when a magnetic field is applied thereto, and therefore the elements have barbs facing in the proper direction regardless of the manner in which they rise upon plate 180.

After the layer 184 has hardened, the magnetic plate 180 is removed, leaving the elements 86 mounted securely on base 182 in upstanding condition, with their lower ends firmly embedded and secured within the hardened layer 184 of adhesive, brazing alloy, glass or the like.

The ends of the thin, bristle-like gripping elements have a penetrating profile. Thus, the ends can be cut off straight across, may be cut angular, may be clipped to a chisel-type end, or may be cold formed into a sharp end, bulbous end, etc. In some instances it may be desirable that the elements be formed so as to minimize abrasion of the receiving substrates or to avoid irritation or of the skin of the user. In this case, the elements may be formed with rounded ends. On the other hand, where the gripping action is a critical factor, the elements may be made with sharp ends.

While various gripping elements having various self-gripping means have been shown and described, it will be understood that numerous other combinations may be used.

It will also be appreciated that a mixture of gripping elements, for example the gripping element shown in FIGS. 1–5 and 12–16, may be used in selected combinations and mounted in predetermined patterns on a single surface or on both sides of a base to provide fastening assemblies suitable to the requirements of various applications.

What is claimed is:

1. Self-gripping device comprising a multiplicity of thin, gripping elements having a bristle-like body uniform in cross section attached in close proximity to each other to a base, each of said gripping elements having self-gripping barbs spaced along the length thereof, said notched barbs being nicked in the body of the bristle-like gripping elements, said barbs being defined by adjoining indentations in and protrusions from said bristle-like body, and being disposed at an acute angle relative to the longitudinal axis of said gripping elements and above the longitudinal surface thereof, said gripping elements extending substantially perpendicularly from said base with at least some of said self-gripping barbs pointing towards said base and being adapted to penetrate and become lodged in a receiving layer for self-gripping engagement therewith.

2. Self-gripping device of claim 1 wherein each of said gripping elements is formed of a single length of wire of uniform cross section and said self gripping barbs extend along said gripping element in at least one longitudinal row.

3. Self-gripping device of claim 2 wherein said gripping element is formed with side walls which meet along longitudinal lines of intersection and said self gripping barbs are formed in rows extending along said lines of intersection.

4. Self-gripping device of claim 2 wherein said gripping element is formed of shaped wire having at least one sharp notched edge.

5. Self-gripping device of claim 2 wherein said barbs are defined by generally converging edge portions, a first group of said barbs being biased pointed toward said base and a second group of said barbs being biased pointed away from said base.

6. Self-gripping device of claim 5 in which said barbs are arranged in longitudinal rows with the barbs of said first group and second group being arranged in alternate alignment in each of said rows.

7. Self-gripping device of claim 5 in which said barbs are arranged in longitudinal rows along said gripping element, with the barbs of said first group forming some of said rows, and the barbs of said second group forming alternate rows.

8. Self-gripping device of claim 5 in which said first group of barbs are arranged along one longitudinal half portion of each gripping element and said second group of barbs are arranged along the other longitudinal half portion of each gripping element, said gripping elements extending entirely through said base with said one half of each gripping element extending from one side of said base and said other half extending from the opposite side thereof.

9. Self-gripping device of claim 1 wherein said gripping elements extend from both sides of said base.

10. Self-gripping device of claim 1 wherein said base comprises a narrow strip of material and said gripping elements are attached in a row along an edge of said strip perpendicularly to the longitudinal axis thereof.

11. Self-gripping device of claim 1 wherein said barbs extend along each gripping element in a single longitudinal row and with said rows of barbs all facing in one direction.

12. Self-gripping device of claim 1 wherein said gripping elements are formed by a U-shaped member having a pair of spaced legs extending through said base and forming said gripping elements.

13. A self-gripping device of claim 1 in which said gripping elements are defined by a closed loop terminating in a pair of oppositely extending gripping elements with a portion of said base enclosed in said loop.

14. Self-gripping device of claim 1 wherein said gripping elements define a tetrahedron having a plurality of legs attached to said base and an upstanding leg forming said gripping element.

15. Self-gripping device of claim 1 wherein said base is a sheet.

16. Self-gripping device of claim 1 wherein said base is a strip.

17. Self-gripping device of claim 1 wherein said base is a disc.

18. Self-gripping device of claim 1 in self gripping engagement with a receiving layer.

* * * * *